US008448792B2

(12) United States Patent
Gelardi et al.

(10) Patent No.: US 8,448,792 B2
(45) Date of Patent: May 28, 2013

(54) PRODUCT DISPENSING SYSTEM WITH BIASING ASSEMBLY

(75) Inventors: John Gelardi, Midlothian, VA (US); Ryan Bailey, Richmond, VA (US)

(73) Assignee: MeadWestvaco Corporation, Richmond, VA (US)

( * ) Notice: Subject to any disclaimer, the term of this patent is extended or adjusted under 35 U.S.C. 154(b) by 206 days.

(21) Appl. No.: 12/897,098

(22) Filed: Oct. 4, 2010

(65) Prior Publication Data

US 2012/0080392 A1 Apr. 5, 2012

(51) Int. Cl.
*A47F 1/126* (2006.01)
*A47F 1/125* (2006.01)

(52) U.S. Cl.
USPC ..... 211/59.3

(58) Field of Classification Search
CPC .. A47F 1/126; A47F 1/25; A47F 5/0823; A47F 5/0869; A47F 5/0876; A47F 1/06; A47F 1/065; A47F 1/035
USPC ..... 211/57.1, 59.1, 54.1, 51, 7, 59.3, 211/46; 221/279; 312/61, 71
See application file for complete search history.

(56) References Cited

U.S. PATENT DOCUMENTS

| | | | | |
|---|---|---|---|---|
| 1,691,743 | A * | 11/1928 | Ulrich | 211/51 |
| 2,060,146 | A * | 11/1936 | Voorhees | 312/273 |
| 2,472,567 | A * | 6/1949 | Bruen | 211/51 |
| 2,853,078 | A * | 9/1958 | Nabholz | 211/51 |
| 3,055,293 | A | 9/1962 | Lariccia | |
| 3,161,295 | A * | 12/1964 | Chesley | 211/59.3 |
| 3,203,554 | A | 8/1965 | Pendergrast et al. | |
| 3,308,961 | A * | 3/1967 | Chesley | 211/59.3 |
| 3,452,983 | A * | 7/1969 | Wood et al. | 271/214 |
| 3,923,159 | A | 12/1975 | Taylor et al. | |
| 4,457,512 | A * | 7/1984 | Stevenson | 273/148 A |
| 4,834,263 | A | 5/1989 | Becze | |
| 5,012,936 | A * | 5/1991 | Crum | 211/59.3 |
| 5,178,298 | A * | 1/1993 | Allina | 221/24 |
| 5,665,304 | A * | 9/1997 | Heinen et al. | 312/71 |
| 5,671,851 | A * | 9/1997 | Johnson et al. | 211/51 |
| 5,855,283 | A * | 1/1999 | Johnson | 211/59.3 |
| 6,601,498 | B1 * | 8/2003 | O'Brion | 99/467 |
| 6,991,116 | B2 | 1/2006 | Johnson et al. | |
| 7,207,447 | B2 | 4/2007 | Medcalf et al. | |
| 7,690,519 | B2 * | 4/2010 | Kahl et al. | 211/59.2 |
| 7,918,353 | B1 | 4/2011 | Luberto | |
| 8,038,017 | B2 * | 10/2011 | Close | 211/59.3 |

(Continued)

FOREIGN PATENT DOCUMENTS

| | | |
|---|---|---|
| DE | 29808673 | 11/1998 |
| DE | 19808162 | 9/1999 |
| WO | 00/54632 | 9/2000 |

OTHER PUBLICATIONS

"Shelf Management System" by Index Plastics Limited (www.indexplastics.co.uk/shelf-management) (Mar. 14, 2011).

(Continued)

*Primary Examiner* — Jennifer E Novosad
(74) *Attorney, Agent, or Firm* — Walters & Wasylyna LLC

(57) ABSTRACT

A product dispensing system including a container that defines an internal volume and an opening into the internal volume, the container housing a plurality of products within the internal volume, and a push member extending through the opening, the push member being biased into engagement with the products in the container.

13 Claims, 12 Drawing Sheets

U.S. PATENT DOCUMENTS

| | | | | |
|---|---|---|---|---|
| 8,066,128 | B2 * | 11/2011 | Crawbuck et al. | 211/59.3 |
| 2001/0000643 | A1 * | 5/2001 | Roeker et al. | 312/61 |
| 2002/0148794 | A1 * | 10/2002 | Marihugh | 211/59.3 |
| 2003/0024889 | A1 * | 2/2003 | Dumontet | 211/59.3 |
| 2004/0065631 | A1 * | 4/2004 | Nagel | 211/59.3 |
| 2005/0072747 | A1 * | 4/2005 | Roslof et al. | 211/59.3 |
| 2005/0092644 | A1 | 5/2005 | Cafferatta | |
| 2005/0161413 | A1 * | 7/2005 | Close | 211/51 |
| 2005/0207877 | A1 | 9/2005 | Haverdink et al. | |
| 2005/0258113 | A1 * | 11/2005 | Close et al. | 211/59.3 |
| 2007/0068885 | A1 * | 3/2007 | Busto et al. | 211/59.3 |
| 2007/0194037 | A1 | 8/2007 | Close | |
| 2009/0212066 | A1 | 8/2009 | Bauer | |
| 2010/0237093 | A1 * | 9/2010 | Lockwood et al. | 221/279 |
| 2011/0215061 | A1 * | 9/2011 | Niederhuefner et al. | 211/59.3 |
| 2012/0118840 | A1 * | 5/2012 | Howley | 211/59.3 |

OTHER PUBLICATIONS

International Search Report and Written Opinion, PCT/US2011/051869.

* cited by examiner

PRODUCT DISPENSING SYSTEM WITH BIASING ASSEMBLY

FIELD

This application relates to the dispensing of products and, more particularly, to the dispensing of products from packaging containers.

BACKGROUND

Products are typically shipped to retailers in bulk by enclosing multiple individual product units in a container such as a carton or box. For example, pharmaceuticals may be shipped to a retailer in a container housing multiple carton units, with each carton unit housing multiple units of pharmaceuticals (e.g., in blister-type packages). Then, a stock clerk typically removes the carton units from the container and stacks them on a display unit, such as a shelf, thereby making the products available to consumers.

The process of removing products from shipping containers and stacking the products on a shelf can be quite time consuming. Specifically, the traditional package-ship-unpack-display model requires a stock clerk to obtain a package from the supplier, open the package, remove all of the product units from the open package, and stack each of the product units on a display, such as a shelf. In the case of small, high volume products, such as pharmaceuticals, the amount of time required to neatly stock a display can become extensive, thereby significantly increasing a retailer's overall operating expenses.

As an alternative to the traditional package-ship-unpack-display model, products are being packaged in containers that also function as product dispensers. For example, packaging containers have been developed that include tear-away seals that, when removed, provide an opening into the container. Therefore, a store clerk is simply required to remove the tear-away seal to form the opening and then place the open container on the display. Consumers may then retrieve products from the container through the opening.

Unfortunately, as products are removed from the container/dispenser, products positioned a distance away from the opening in the container/dispenser may become difficult to retrieve. The difficulty may be particularly significant when the opening in the container/dispenser is relatively small and/or when the container/dispenser is relatively large or elongated.

Accordingly, those skilled in the art continue with research and development efforts in the field of product packaging and dispensing.

SUMMARY

In one aspect, the disclosed product dispensing system may include a container that supports a plurality of products and a push member biased into engagement with the products in the container.

In another aspect, the disclosed product dispensing system may include a container that defines an internal volume and an opening into the internal volume, the container housing a plurality of products within the internal volume, and a push member extending through the opening, the push member being biased into engagement with the products in the container.

In another aspect, the disclosed product dispensing system may include an elongated rail having a proximal end and a distal end, a container positioned proximate the distal end of the rail, the container defining an internal volume and an opening into the internal volume, the container housing a plurality of products within the internal volume, a sled slidably engaged with the rail and biased toward the distal end of the rail, and a push member connected to the sled and extending through the opening and into engagement with the products in the container.

In yet another aspect, the disclosed product dispensing system may include an elongated rail having a proximal end and a distal end, a stop positioned at the distal end of the rail, a container positioned between the proximal end of the rail and the stop, the container defining an internal volume and an opening into the internal volume, the container housing a plurality of products within the internal volume, a sled slidably engaged with the rail, a biasing element engaged with the sled to bias the sled toward the distal end of the rail, and a push member connected to the sled and extending through the opening and into engagement with the products in the container.

Other aspects of the disclosed product dispensing system with biasing assembly will become apparent from the following description, the accompanying drawings and the appended claims.

DETAILED DESCRIPTION

Referring to FIGS. 1-4, one aspect of the disclosed product dispensing system with biasing assembly, generally designated 10, may include a container 12 and a biasing assembly 14. The container 12 may house a plurality of products 16 and the biasing assembly 14 may extend into the container 12 to apply a biasing force to the products 16 to urge the products 16 relative to the container 12.

Figure 3:
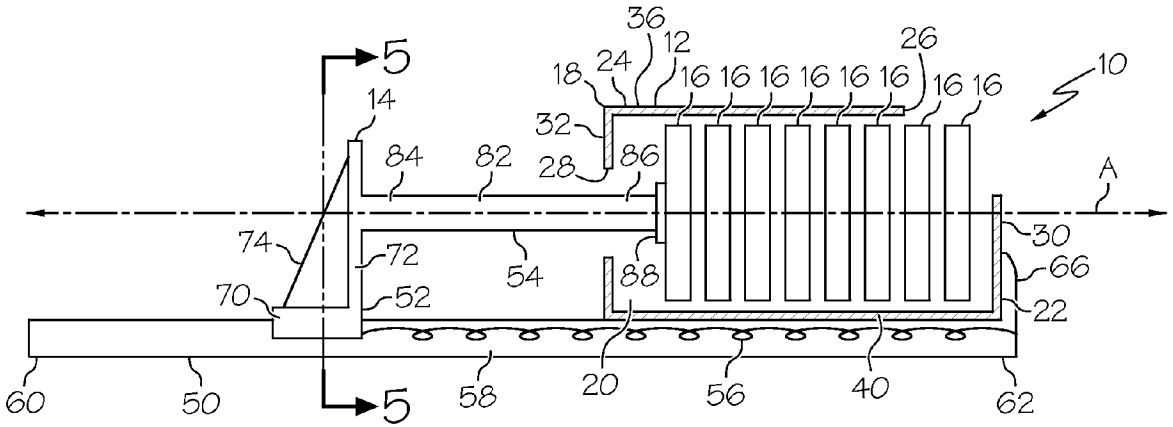
FIG. 3 is a schematic side elevational view, in section, of the product dispensing system of FIG. 1, shown in a first configuration.
Figure 4:
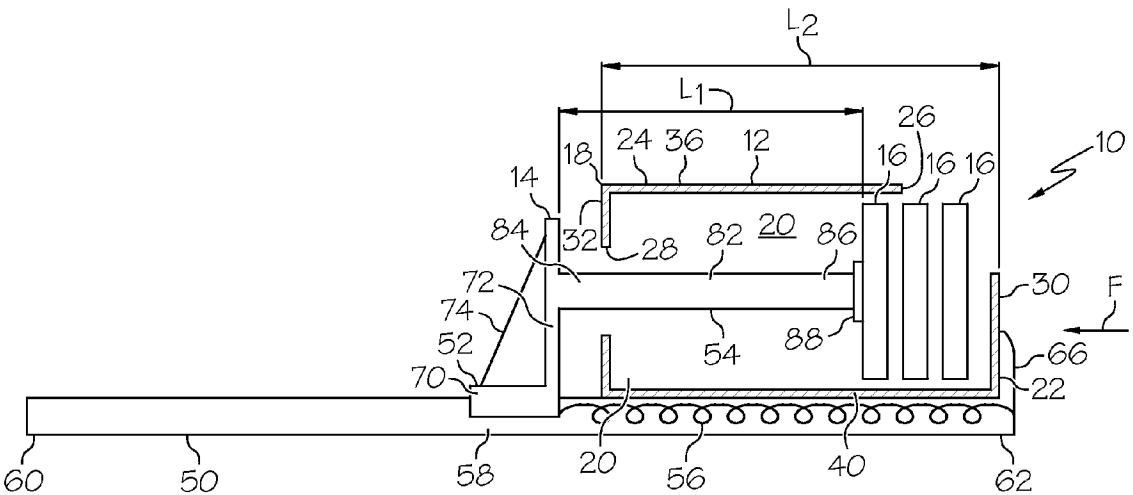
FIG. 4 is a schematic side elevational view, in section, of the product dispensing system of FIG. 3, shown in a second configuration.

The container 12 may include a three-dimensional body 18 that defines an internal volume 20 (FIGS. 3 and 4). The body 18 of the container 12 may include a front end 22 and a rear end 24. The exterior of the container 12, such as the exterior of the front end 22 of the container 12, may be marked with indicia 23 (FIG. 1), such as advertising text and/or graphics. The rear end 24 of the container 12 may be spaced apart from the front end 22 of the container 12 along a longitudinal axis A (FIG. 3) of the container 12.

As an example, the body 18 of the container 12 may be formed from a paperboard-based material, such as C1S or C2S paperboard. However, those skilled in the art will appreciate that various materials, such as polymeric materials, may also be used to construct the body 18 of the container 12.

The front end 22 of the container 12 may define a first opening 26 into the internal volume 20. The opening 26 may be sized and shaped to allow products 16 to pass therethrough. As an example, the system 10 may be positioned on a store shelf such that the first opening 26 is positioned proximate the front edge of the shelf. Therefore, the opening 26 may provide consumers with access to the products 16 positioned in the internal volume 20 proximate (i.e., at or near) the front end 22 of the container 12.

In one expression, the first opening 26 in the container 12 may be formed by cutting the container 12, such as with a cutting blade. In another expression, the first opening 26 in the container 12 may be formed by tearing away a portion of the container 12 along one or more pre-formed tear lines (not shown). The pre-formed tear lines may be perforations or the like having a tear strength that is sufficiently low to allow manual separation of a portion of the container 12 along the pre-formed tear lines.

The rear end 26 of the container 12 may include a second opening 28 into the internal volume 20. The second opening 28 may function as an access port through which the biasing assembly 14 may extend to engage the products 16 in the container 12, as best shown in FIGS. 3 and 4.

In one particular construction, the body 18 of the container 12 may be formed as a three-dimensional rectilinear body having a front wall 30, a rear wall 32 and four longitudinal side walls 34, 36, 38, 40 extending between the front 30 and rear 32 walls. The first opening 26 may be formed in the front wall 30 and may extend into one or more of the side walls 34, 36, 38. The second opening 28 may be formed in the rear wall 32.

Figure 2:
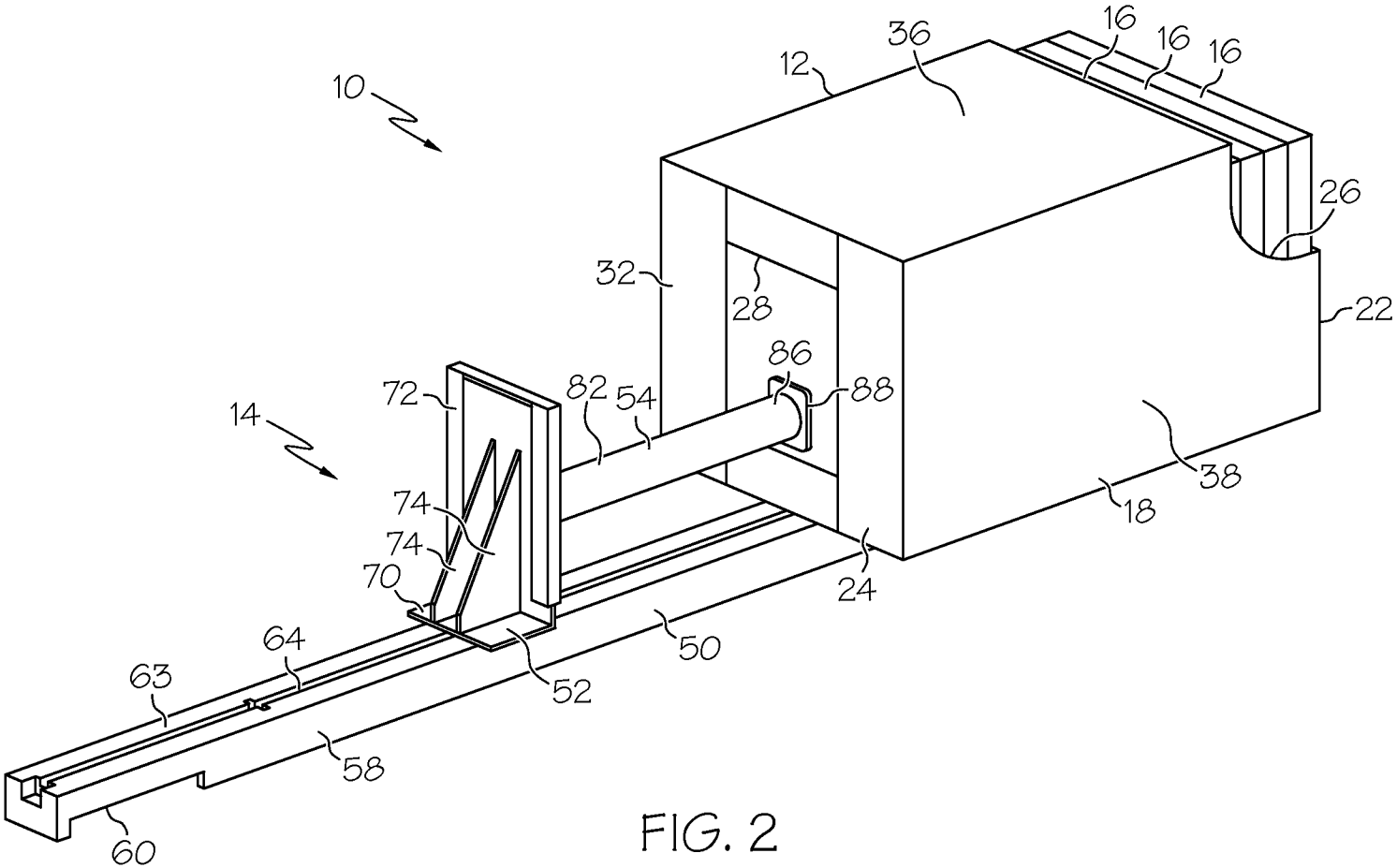
FIG. 2 is a rear perspective view of the product dispensing system of FIG. 1.

Those skilled in the art will appreciate that various techniques may be used to form the opening 28 in the rear wall 32 of the container 12. In one expression, the second opening 28 may be formed in the rear wall 32 by overlapping short panels, as shown in FIG. 2. In another expression, the second opening 28 may be formed in the rear wall 32 by cutting or tearing the rear wall 32. For example, the second opening 28 may be formed by tearing the rear wall 32 along pre-formed tear lines (not shown). In yet another expression, the second opening 28 may be formed in the rear wall 32 by pivoting one or more hinged flaps (not shown) connected to the rear wall 32. Therefore, the hinged flap(s) may seal the second opening 28 when the container 12 is not mounted on the biasing assembly 14, but may allow a portion (the push member 54) of the biasing assembly 14 to pass through the second opening 28.

Figure 6:
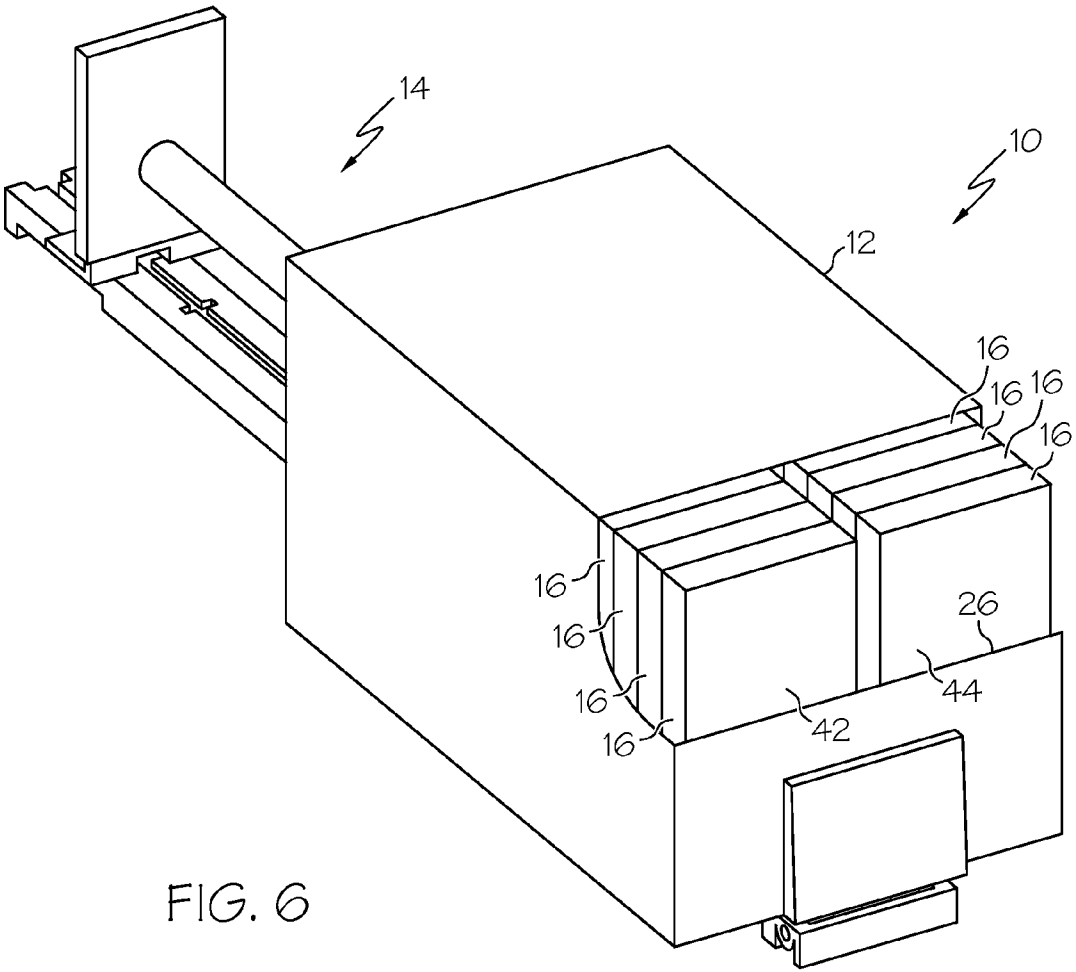
FIG. 6 is a front perspective view of the product dispensing system of FIG. 1, shown dispensing multiple rows of product.

As shown in FIG. 3, the products 16 may be received in the internal volume 20 of the container 12, and may be longitudinally arranged in a row between the front 22 and rear 24 ends of the container 12. In one alternative expression, two or more rows 42, 44 of product 16 may be simultaneous dispensed from a single container 12, as shown in FIG. 6, without departing from the scope of the disclosure. The biasing assembly 14 may urge the products 16 toward the front end 22 of the container 12. In another alternative expression, the products 16 may be arranged in the container 12 other than in rows, such as in a staggered (e.g., zigzag) pattern or randomly. Those skilled in the art will appreciate that a staggered pattern may optimize the use of space in the container 12 when the products are generally cylindrical (e.g., cans or bottles).

Those skilled in the art will appreciate that a wide variety of products 16 may be packaged in, and dispensed from, the container 12 of the disclosed product dispensing system 10. As one example, the products 16 may be various foodstuffs packaged in boxes, cartons, pouches, cans or bottles. As another example, the products 16 may be various consumer goods, and may or may not be individually contained in a package, such as a box, carton, clamshell, pouch or the like. Other examples of products 16 suitable for being dispensed from the disclosed product dispensing system 10 are left to the skilled artisan.

Still referring to FIGS. 1-4, the biasing assembly 14 may include a rail 50, a sled 52, a push member 54 and a biasing element 56 (FIGS. 3 and 4). The sled 52 may be slidably engaged with the rail 50 and may include the push member 54 connected thereto. The biasing element 56 may urge the sled 52 toward the container 12 such that the push member 54 extends through the second opening 28 in the container 12 and urges the products 16 within the internal volume 20 of the container 12 to the front end 22 of the container 12.

The rail 50 may include a longitudinal body 58 having a proximal end 60 and a distal end 62. The body 58 of the rail 50 may define a sliding surface 63 having an elongated track 64 formed therein. The elongated track 64 may extend from proximate the proximal end 60 of the rail 50 to proximate the distal end 62 of the rail 50. The container 12 may be positioned on the rail 50 proximate the distal end 62 of the rail 50 such that the longitudinal axis A of the container 12 is generally aligned (e.g., parallel) with the elongated track 64.

A stop 66 may be positioned proximate the distal end 62 of the rail 50 such that the front end 22 of the container 12 abuts the stop 66. Therefore, the stop 66 may function to prevent (or at least inhibit) longitudinal movement of the container 12 distally beyond the stop 66.

Figure 1:
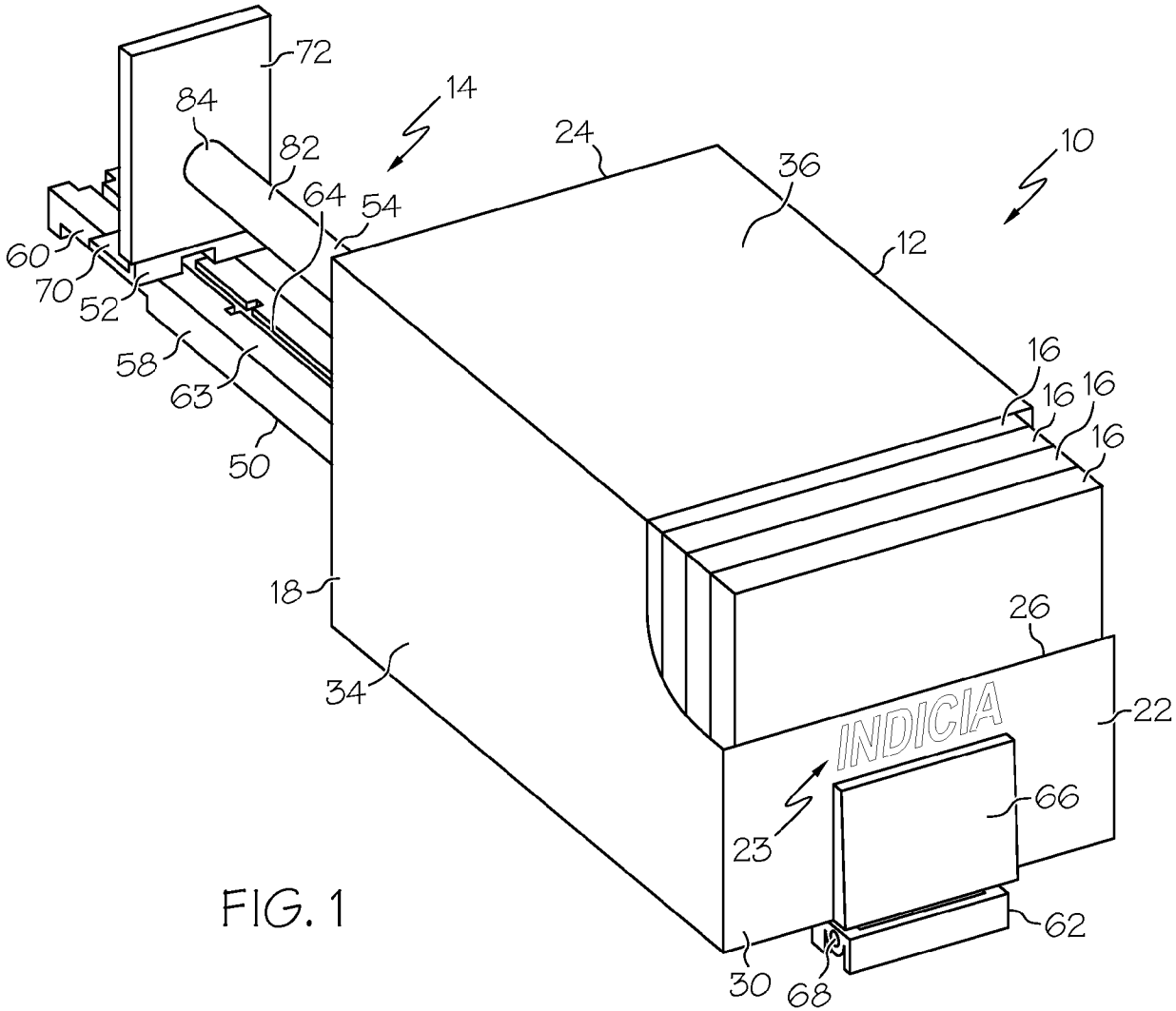
FIG. 1 is a front perspective view of a first aspect of the disclosed product dispensing system with biasing assembly.

As shown in FIG. 1, the stop 66 may be connected to the rail 50 at an optional pivot point 68. Therefore, the stop 66 may pivot from the distal-most configuration shown in FIG. 1 to a collapsed configuration when a proximal force (arrow F, FIG. 4) is applied to the stop 66, such as when a container 12 is loaded onto the biasing assembly 14.

The sled 52 may include a base 70 and a face panel 72 connected to the base 70. The face panel 72 of the sled 52 may extend generally perpendicularly from the base 70 and may include the push member 54 distally protruding therefrom. Optional struts 74 may extend from the face panel 72 to the base 70 to resist pivotal movement of the face panel 72 relative to the base 70.

The base 70 of the sled 52 may be slidably engaged with the rail 50 such that the sled 52 may move longitudinally along the sliding surface 63 of the rail 50 between the proximal 60 and distal 62 ends of the rail. In one particular expression, the rear end 24 of the container 12 may limit the distal advancement of the sled 52. Those skilled in the art will appreciate that various techniques may be used to effect a sliding engagement between the rail 50 and the sled 50, and that variation in the techniques used to effect such a sliding engagement will not result in a departure from the scope of the present disclosure.

Figure 5:
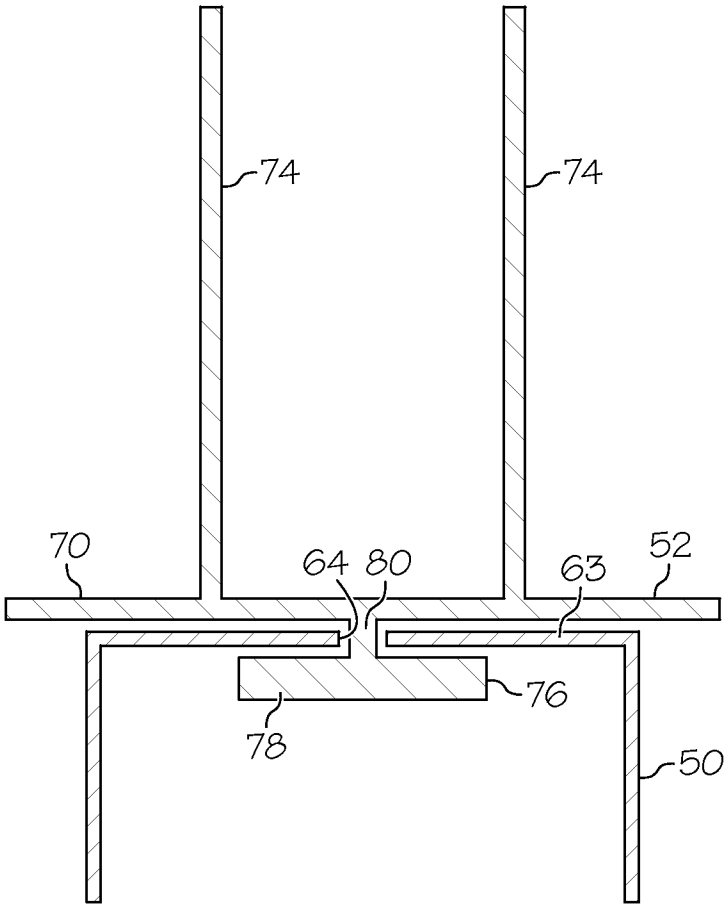
FIG. 5 is a schematic front elevational view, in section, of the product dispensing system of FIG. 3.

As shown in FIG. 5, in one particular construction, the base 70 of the sled 52 may include a T-shaped member 76 connected thereto and engaged with the rail 50. The T-shaped member may include a cross member 78 and a tie member 80 connecting the cross member 78 to the base 70 of the sled 52. The tie member 80 may extend through the track 64 in the rail 50 such that a portion of the rail 50 (particularly a portion of the sliding surface 64) is positioned between the base 70 of the sled 70 and the cross member 78. Therefore, the sled 52 (particularly the tie member 80) may move longitudinally through the track 64 in the rail 50, but the cross member 78 may resist separation of the sled 52 from the rail 50.

The push member 54 may include an elongated body 82 having a proximal end 84 and a distal end 86. The elongated body 82 of the push member 54 may have a longitudinal length $L_1$ (FIG. 4), which may be sufficient to extend through all (or at least most) of the longitudinal length $L_2$ (FIG. 4) of the container 12. For example, the push member 54 may be an elongated rod, which may be solid or tubular, and which may have a generally circular cross-sectional profile in end view. However, push members 54 having other shapes, configurations and cross-sectional profiles are also contemplated.

Optionally, a plate 88 or the like may be disposed at the distal end 86 of the push member 54 to increase the cross-sectional area of the distal end 86 of the push member 54. The plate 88 may be contoured to the shape of the products 16 in the container 12. Therefore, the body 82 of the push member 54 may be provided with a relatively thin and lightweight cross-sectional profile, but the distal end 86 of the push member 88 may have a sufficient cross-sectional area to engage the products 16 in the container 12.

The proximal end 84 of the push member 54 may be connected to the face panel 72 of the sled 52 such that the distal end 86 of the push member 54 protrudes outward from the face panel 72. In one construction, the push member 54 may be permanently connected to the sled 52. For example, the push member 54 may be integral with the sled 52 (i.e., the push member 54 and the sled 52 may be formed as a single monolithic body). In another construction, the push member 54 may be detachable from the sled 52, such as by sliding the push member 54 off of the face panel 72.

The push member 54 may be connected to the face panel 72 of the sled 52 such that the elongated body 82 of the push member 54 is generally longitudinally aligned with the longitudinal axis A (FIG. 3) of the container 12. Therefore, as the sled 52 moves in the distal direction (i.e., toward distal end 62) relative to the rail 50, the distal end 86 of the push member 54 may extend through the second opening 28 in the container 12 and into engagement with the products 16 within the container 12. The engagement between the push member 54 and the products 16 may be direct or indirect.

While only one push member 54 is shown connected to the sled 52, additional push members 54 are also contemplated. For example, when the products 16 are arranged in multiple rows, as shown in FIG. 6, the sled 52 may be provided with a push member 54 for each such row of products 16.

The biasing element 56 may be connected to the sled 52 to urge the sled 52 and, ultimately, the push member 54 in the distal direction. Those skilled in the art will appreciate that various elements may be used to urge the sled 52 in the distal direction, and that variation in the elements used to effect such a bias will not result in a departure from the scope of the present disclosure.

In one implementation, the biasing element 56 may be a tension spring, and may include a first end 90 connected to the sled 52 and a second end 92 connected to the distal end 62 of the rail 50, as shown in FIGS. 3 and 4. While a helical coil tension spring is shown, another example of a suitable tension spring is a rolled, tape measure-style extension spring.

In another implementation, the biasing element 56 may be a compression spring. For example, while not shown, the compression spring may be positioned between the proximal end 60 of the rail 50 and the sled 52 to urge the sled 52 in the distal direction.

Accordingly, when the container 12 is mounted on the biasing assembly 14, the biasing element 56 urges the sled 52 and associated push member 54 in the distal direction, through the second opening 28 in the container 12, and into engagement with the products 16 in the container 12. Therefore, as shown in FIGS. 3 and 4, as the distal most products 16 are withdrawn from the container 12 through the first opening 26, the remaining products 16 are urged by the push member 54 toward the front end 22 of the container 12 such that products 16 are always positioned proximate the first opening 26.

Figure 7:
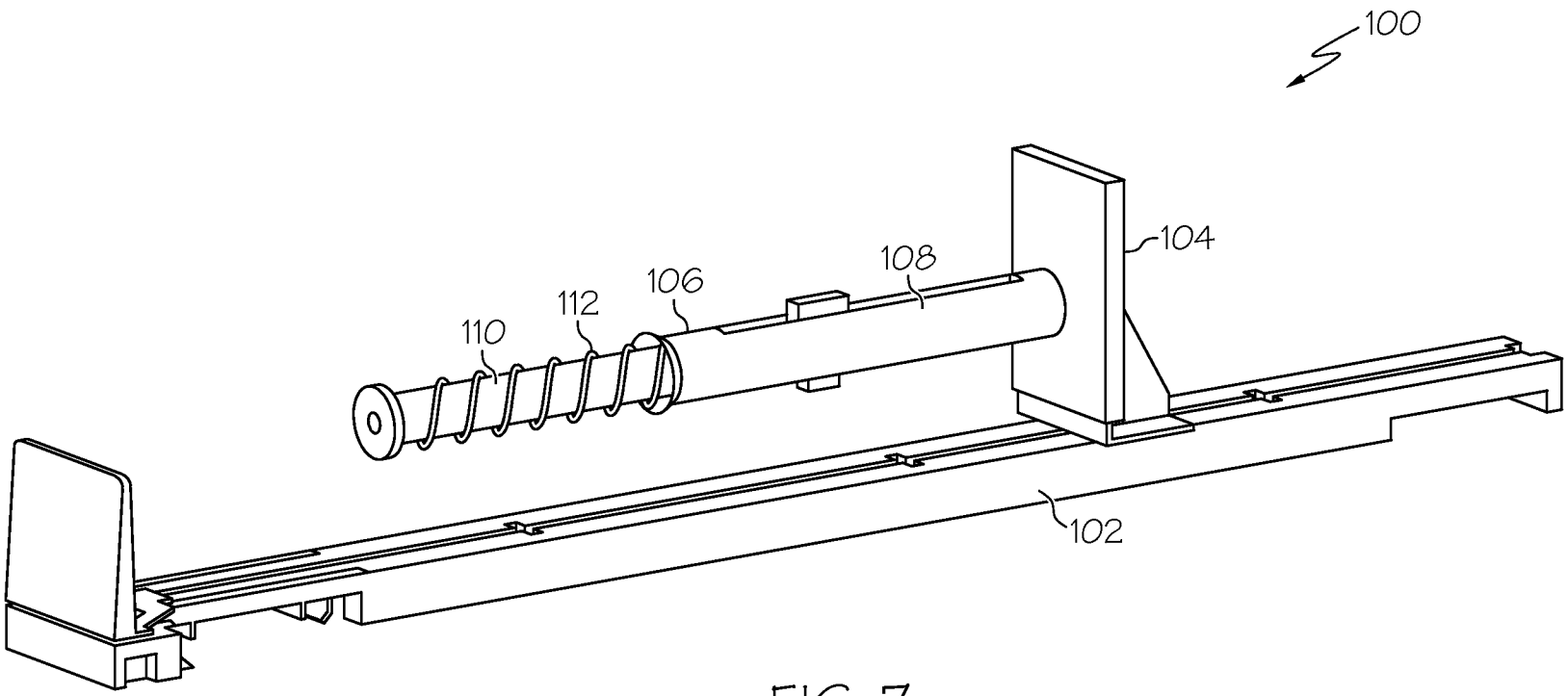
FIG. 7 is a side perspective view of a biasing assembly in accordance with a second aspect of the disclosed product dispensing system with biasing assembly.

Referring to FIG. 7, in a second aspect, the disclosed product dispensing system with biasing assembly may include a container (not shown, but which may be the same as or similar to the container 12 shown in FIG. 1) and a biasing assembly 100. Like biasing assembly 14, biasing assembly 100 may include a rail 102, a sled 104, a push member 106 and a biasing element (not shown, but which may be the same as or similar to the biasing element 56 shown in FIG. 3). However, the push member 106 of the biasing assembly 100 may be a telescoping push member.

In one construction of the second aspect, the push member 106 may include an elongated tubular housing 108, a plunger member 110 and a biasing element 112. The plunger member 110 may be received in, and may extend from, the housing 108, thereby providing the push member 106 with a variable longitudinal length $L_1'$ (FIG. 9).

Figure 9:
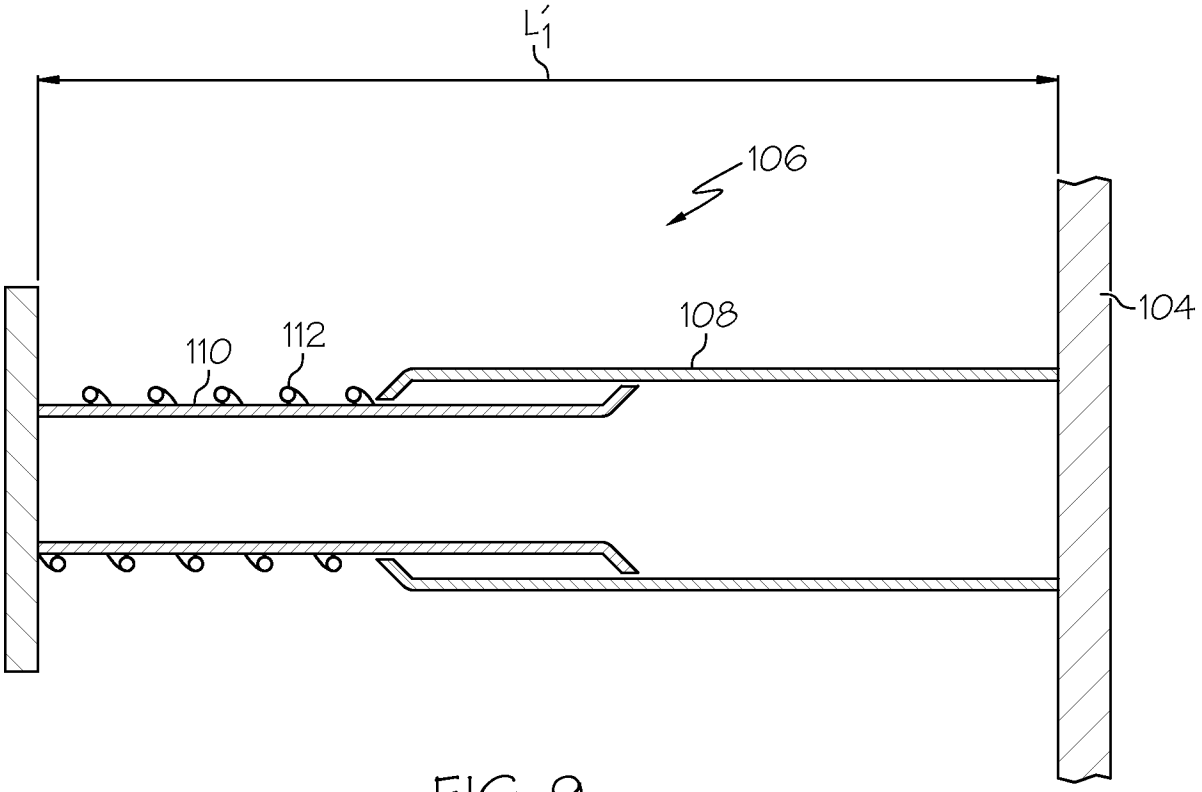
FIG. 9 is a schematic side elevational view, in section, of the pusher member of FIG. 8, shown in a partially retracted configuration.
Figure 10:
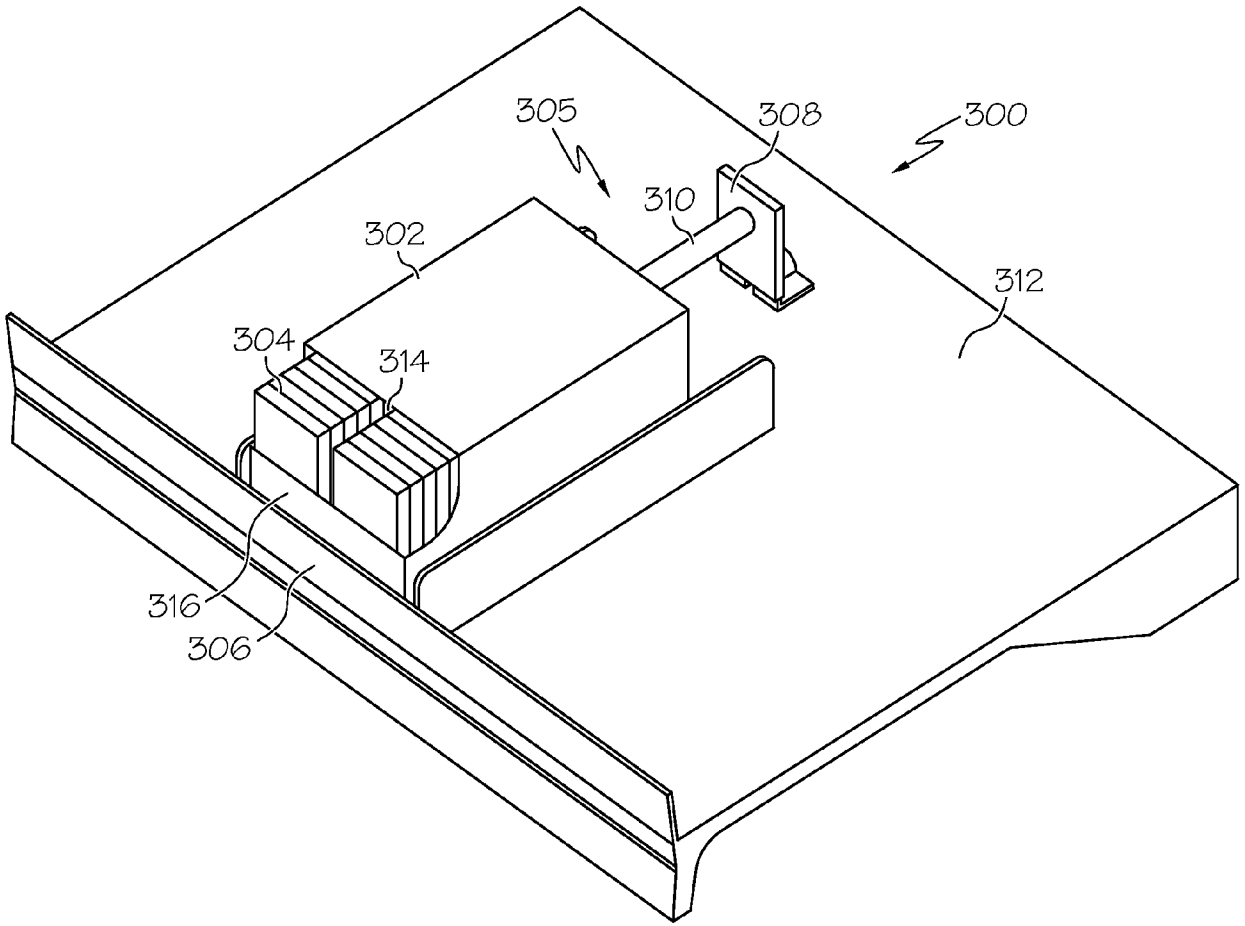
FIG. 10 is a side perspective view of a third aspect of the disclosed product dispensing system with biasing assembly.

As shown in FIGS. 9 and 10, the tubular housing 108 may include a proximal end 114, a distal end 116 and a bore 117 extending from the proximal end 114 to the distal end 116. The proximal end 114 of the housing 108 may be connected, either removably or fixedly, to the sled 104. The distal end 116 of the housing 108 may include a stop 118. As an example, the stop 118 may be formed as a radially inward extending portion of the distal end 116 of the tubular housing 108.

The plunger member 110 may include a proximal end 120 that includes a flange 122 and a distal end 124 that optionally includes a push plate 126 connected thereto. The plunger member 110 may be slidably received in the bore 117 defined by the housing 108 and may extend from the distal end 116 of the housing 108.

Figure 8:
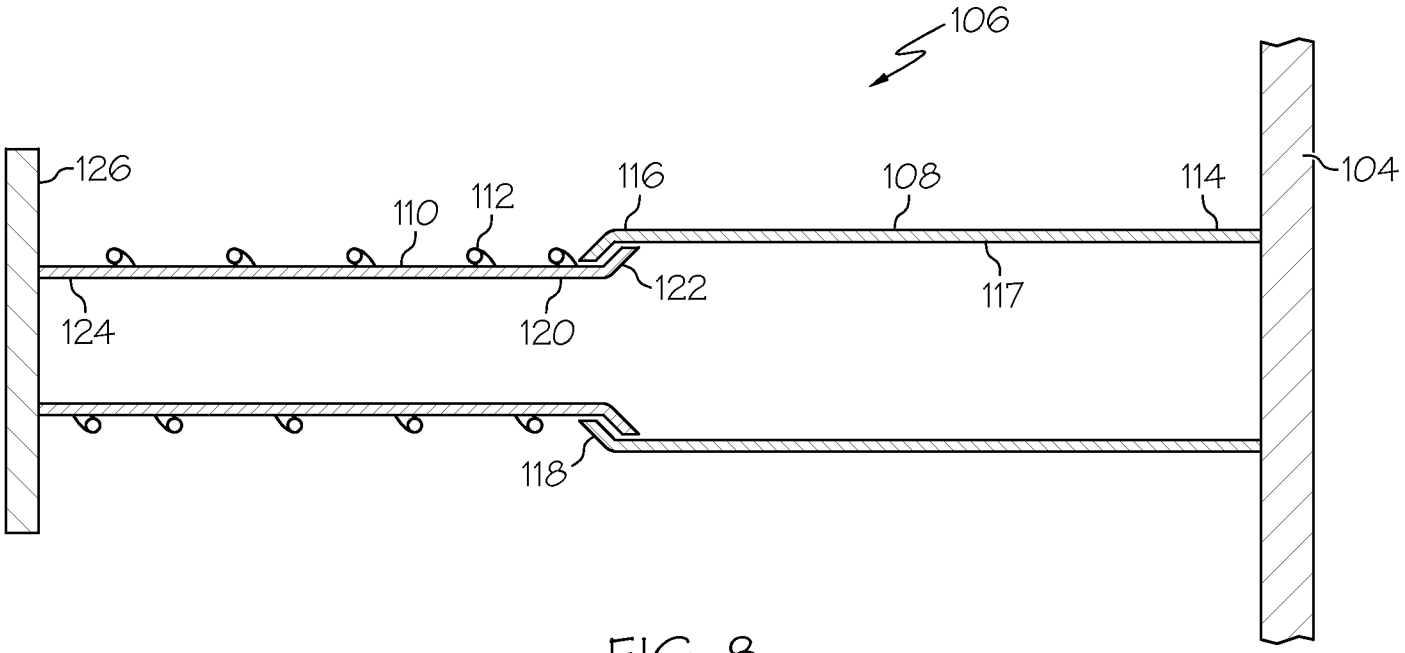
FIG. 8 is a schematic side elevational view, in section, of the pusher member of the product dispensing system of FIG. 7, shown in a fully extended configuration.

The biasing element 112 may bias the plunger member 110 out of, and away from, the bore 117 of the housing 108. For example, the biasing element 112 may be a coil compression spring coaxially received over the plunger member 110 and bounded between the push plate 126 and the housing 108. The engagement between the flange 122 of the plunger member 110 and the stop 118 of the housing 108 may restrict extension of the plunger member 110 beyond the extension shown in FIG. 8.

While the push member 106 is shown and described as being formed from two extension members, namely the housing 108 and the plunger member 110, those skilled in the art will appreciate that the push member 106 may telescope with additional extension members. For example, the plunger member 110 may be configured as an elongated tubular housing for a second plunger member (not shown).

At this point, those skilled in the art will appreciate that the ability to reduce the longitudinal length of the push member 106 by compressing the plunger member 110 into the bore 117 defined by the housing 108 may reduce the amount of shelf depth required to deploy the biasing assembly 100 of the disclosed product dispensing system.

Figure 11:
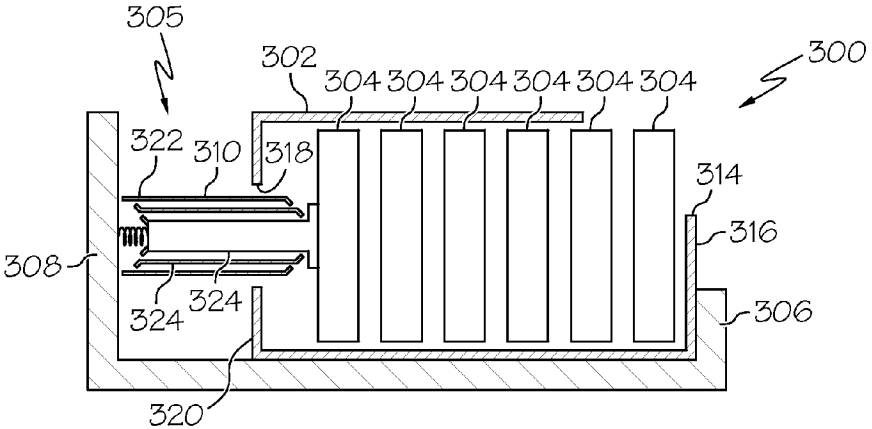
FIG. 11 is a schematic side elevational view, in section, of the product dispensing system of FIG. 10, shown in a first configuration.
Figure 12:
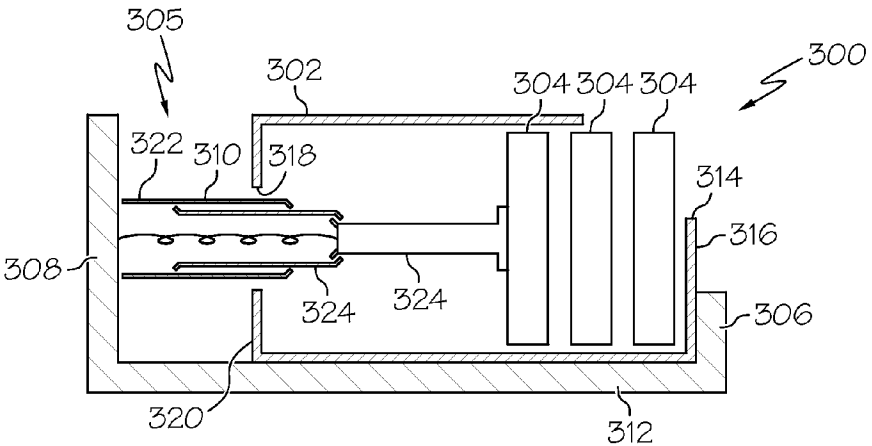
FIG. 12 is a schematic side elevational view, in section, of the product dispensing system of FIG. 11, shown in a second configuration.

Referring to FIGS. 10-12, a third aspect of the disclosed product dispensing system with biasing assembly, generally designated 300, may include a container 302 housing a plurality of products 304 and a biasing assembly 305 that includes a front stop 306, a rear stop 308 and a push member 310. The product dispensing system 300 may be mounted on a display 312, such as a shelf.

Like the containers described above, container 302 may include a first opening 314 in a first (distal/front) end 316 of the container 302 and a second opening 318 in a second (rear/proximal) end 320 of the container 302. The first opening 314 may provide users with access to the products 304 housed in the container 302. The second opening 318 may provide the push member 310 with access to the products 304 in the container 302 such that the push member 310 may urge the products 304 to the front end 316 of the container 302.

The push member 310 may be connected to the rear stop 308 and may extend through the second opening 318 in the container 302 to engage the products 304 therein. Similar to push member 106, push member 310 may include an elongated tubular housing 322, one or more plunger members 324 and one or more biasing elements 326, as shown in FIGS. 11 and 12. The biasing element 326 may urge the plunger members 324 to the distal-most configuration (FIG. 12) such that the distal end 328 of the push member 310 engages and urges the products 304 in the container 302 toward the front end 316 of the container 302.

The front stop 306 may supply a counterforce to the front end 316 of the container 302, thereby resisting distal movement of the container 302 beyond the front stop 306. The rear stop 308 may support the push member 310 and may supply a counterforce to the push member 310 as the push member 310 applies a pushing force to the products 304 in the container 302.

Unlike the product dispensing systems previously described, the push member 310 is not connected to a moving sled, but rather is connected to a stationary structure (e.g., the back wall of shelf), referred to generally as the rear stop 308. Therefore, the product dispensing system 300 relies entirely on the extension function of the push member 310 to urge products 304 to the front end 316 of the container 302.

Figure 13:
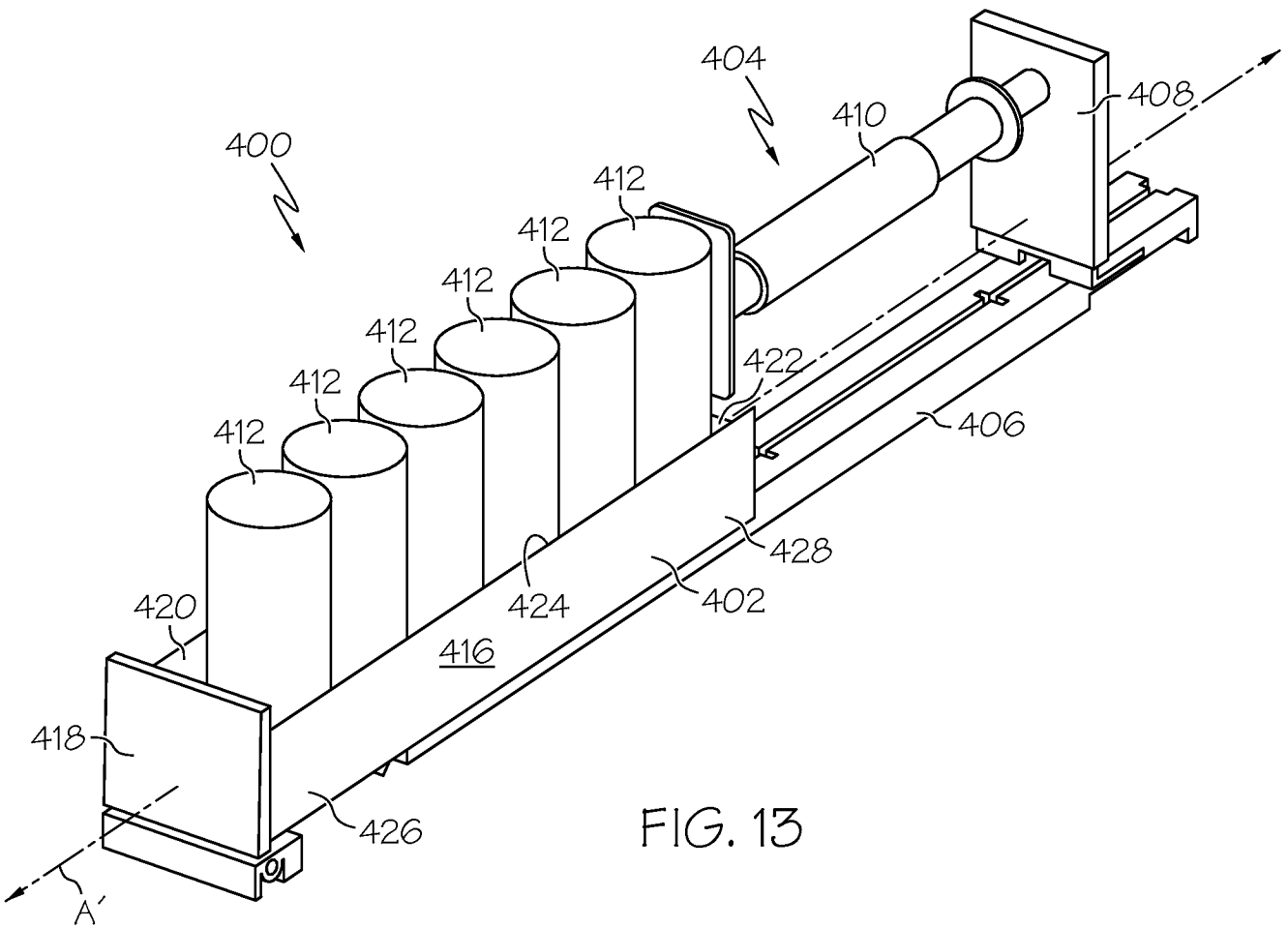
FIG. 13 is a front perspective view of a fourth aspect of the disclosed product dispensing system with biasing assembly.
Figure 14:
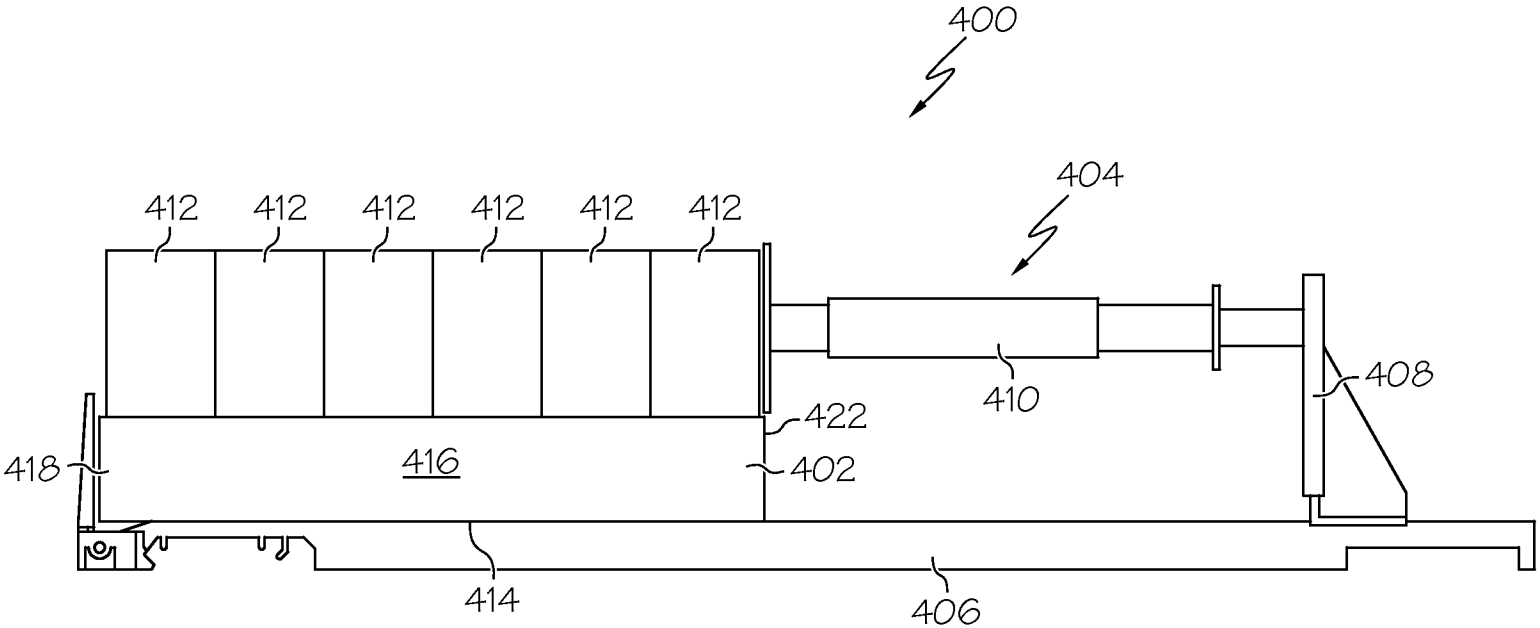
FIG. 14 is a side elevational view of the product dispensing system of FIG. 13.

Referring to FIGS. 13 and 14, a fourth aspect of the disclosed product dispensing system with biasing assembly, generally designated 400, may include a container 402 and a biasing assembly 404. In one implementation, the biasing assembly 404 may include a rail 406, a sled 408, a push member 410 and a biasing element (not shown), similar to the biasing assemblies 14, 100 described above. In another implementation (not shown), the biasing assembly 404 may be similar to the biasing assembly 305 described above in connection with product dispensing system 300.

The container 402 may be formed as a tray and may support a plurality of products 412 therein. As an example, the container 402 may be a rectilinear tray and may include a base wall 414 and a plurality of side walls 416, 418, 420, 422. The side walls 416, 418, 420, 422 of the container/tray 402 may define an opening 424 for receiving the products 412. The products 412 may be arranged (e.g., in a row) from the front end 426 of the container/tray 402 to the rear end 428 of the container/tray 402.

The push member 410 may be generally aligned with the longitudinal axis A' of the container/tray 402 such that the push member 410 is extendable longitudinally across the container/tray 402 to engage (either directly or indirectly) and push the products 412 supported on the container/tray 402 without being obstructed by the container/tray 402. For example, the push member 410 may be generally parallel with, but vertically spaced from, the longitudinal axis A' of the container/tray 402.

Accordingly, when the container/tray 402 is mounted on the biasing assembly 404, the push member 410 may be urged in the distal direction (i.e., toward the front end 426 of the container 402) into engagement with the products 412 in the container/tray 402. Therefore, when the distal most products 412 are withdrawn from the container/tray 402, the remaining products 412 are urged toward the front end 426 of the container/tray 402 such that products 412 are always positioned proximate the front end 426 of the container/tray 402.

Accordingly, the disclosed product dispensing systems are configured to forward-bias products in a container.

Although various aspects of the disclosed product dispensing system with biasing assembly have been shown and described, modifications may occur to those skilled in the art upon reading the specification. The present application includes such modifications and is limited only by the scope of the claims.

What is claimed is:

1. A product dispensing system comprising:

a rail having a proximal end and a distal end, wherein said rail is elongated along a first longitudinal axis;

a container positioned proximate said distal end, said container comprising a front end and a rear end defining an internal volume and an opening into said internal volume disposed at said rear end, said container housing a plurality of products within said internal volume;

a sled slidably engaged with said rail outside of said container and biased toward said distal end; and a push member connected to said sled, wherein said push member is elongated along a second longitudinal axis, said second longitudinal axis being parallel with said first longitudinal axis, and wherein said push member extends through said opening and into engagement with said plurality of products.

2. The product dispensing system of claim 1 wherein said container comprises a front wall, a rear wall and at least one side wall extending between said front wall and said rear wall.

3. The product dispensing system of claim 2 wherein said opening is in said rear wall.

4. The product dispensing system of claim 2 wherein said front wall includes a second opening, and wherein said plurality of products are biased to said front wall.

5. The product dispensing system of claim 4 wherein said second opening is sized to allow individual products of said plurality of products to pass therethrough.

6. The product dispensing system of claim 1 wherein said container comprises paperboard.

7. The product dispensing system of claim 1 further comprising a biasing element positioned to apply a biasing force to said sled.

8. The product dispensing system of claim 7 wherein said biasing element comprises a tension spring.

9. The product dispensing system of claim 1 wherein said push member comprises a housing that defines a bore and a plunger member slidably received in said bore and biased out of said bore.

10. The product dispensing system of claim 1 wherein said sled extends generally perpendicularly from said rail.

11. The product dispensing system of claim 1 further comprising a stop connected to said distal end of said rail.

12. The product dispensing system of claim 1 wherein said push member comprises a first extension member and a second extension member, said second extension member being biased away from said first extension member.

13. A product dispensing system comprising:

a rail having a proximal end and a distal end, wherein said rail is elongated along a first longitudinal axis a stop positioned proximate said distal end;

a container positioned between said proximal end and said stop, said container comprising a front wall, a rear wall, and at least one side wall extending between said front and said rear wall, said front wall, said rear wall and said side wall defining an internal volume, said rear wall defining an opening into said internal volume, said container housing a plurality of products within said internal volume;

a sled slidably engaged with said rail outside of said container;

a biasing element engaged with said sled to bias said sled toward said distal end of said rail; and a push member connected to said sled, wherein said push member is elongated along a second longitudinal axis, said second longitudinal axis being parallel with said first longitudinal axis, and wherein said push member extends through said opening.

* * * * *